US006435795B1

(12) United States Patent
Brady

(10) Patent No.: US 6,435,795 B1
(45) Date of Patent: Aug. 20, 2002

(54) CARGO LOAD RETRACTABLE RECEIVER

(75) Inventor: David J. Brady, Marlton, NJ (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/696,298

(22) Filed: Oct. 26, 2000

(51) Int. Cl.[7] ..... B61B 7/00
(52) U.S. Cl. ..... 414/138.4; 104/114; 212/314
(58) Field of Search ..... 414/137.9, 138.4; 212/314; 104/114

(56) References Cited

U.S. PATENT DOCUMENTS 3,224,379 A * 12/1965 Miller ..... 414/137.9 X
3,589,299 A * 6/1971 Ingram ..... 414/137.9 X
3,642,152 A * 2/1972 Schneller ..... 104/116 X
3,707,922 A * 1/1973 Dillon ..... 414/138.4 X
3,713,548 A * 1/1973 Hanke ..... 414/138.3
3,727,650 A * 4/1973 Ingram et al. ..... 414/138.4 X
3,787,031 A * 1/1974 Lucas ..... 414/139.3 X
3,802,575 A * 4/1974 Ingram et al. ..... 414/142.7 X
3,945,508 A * 3/1976 Colin ..... 414/138.4

* cited by examiner

*Primary Examiner*—Janice L. Krizek
(74) *Attorney, Agent, or Firm*—Jacob Shuster

(57) ABSTRACT

A tubular post is erected from a retracted position in the deck of a load receiving ship to accommodate load transfer operation. A highline connection established by an automated rigging technique substantially reduces manpower requirements, with all receiving station equipment stowed below deck for watertight integrity and to minimize radar cross-section.

3 Claims, 1 Drawing Sheet

CARGO LOAD RETRACTABLE RECEIVER

The present invention relates generally to the transfer of solid loads between marine vessels at seawater locations.

BACKGROUND OF THE INVENTION

According to current standard methods, solid cargos such as munitions and palletized loads are transferred by tensioned wire rope between ships during seawater travel. Such wire rope extends as a cargo transfer highline from a load replenishment ship and is terminated at a load receiving ship for shuttling a load at a sufficient height above seawater surface. Upon arrival at the receiving ship, the load is lowered onto its deck to enable performance of a load disconnect task. A post structure is erected, out of a recessed pocket in the receiving ship deck, through a rotational motor driven arrangement. The post structure in its erected position has the wire rope attached thereto for highline load transfer operation. Stowing of such post structure, erection thereof and attachment of the highline wire rope thereto is laborious for personnel. It is therefore an important object of the present invention to provide for automated highline wire rope connection between underway seagoing ships, which reduces the laborious nature of the load transfer task heretofore involved as well as to require a less cumbersome structural arrangement for performance of such task.

SUMMARY OF THE INVENTION

In accordance with the present invention, an inhaul portion of a flexible rope wire is stored as an inhaul whip in an unintensioned condition within the load receiving ship, from which it is withdrawn through a tubular post after vertical displacement thereof from a retracted position to an upper erected position from a vertically elongated pocket in the ship deck. From such receiving ship, a small shot line portion of the rope wire is projected to the replenishing ship from an outboard end of the inhaul whip. After the replenishing ship receives the shot line in the erected position of the tubular post, the inhaul whip portion of the rope wire is extended to the replenishment ship and after reception by the replenishing ship, it connects to a highline. The receiving ship hauls the highline back fully into an automated latching device mounted in the tubular post top. Personnel on the receiving ship disconnect the inhaul whip and the replenishing ship hauls the inhaul whip back. The replenishing ship then tensions the highline. The inhaul whip is then connected to a pulley block which is hauled over by the receiving ship until automatic engagement occurs. The replenishing ship then commences to send the load. Upon arrival of the load at the receiving station, the tubular post is lowered to place the load onto the deck where automatic load release occurs. After load transfer is completed, the pulley block and then the highline are disconnected under automatic remote control from the receiving ship followed by the retractable tubular post being lowered into stowage position on the deck. The inhaul whip is maintained in a rigged manner through the retracted tubular post for storage in the receiving ship before future reuse.

BRIEF DESCRIPTION OF DRAWING

A more complete appreciation of the invention and many of its attendant advantages will be readily appreciated as the same becomes better understood by reference to the following detailed description when considered in connection with the accompanying drawing herein.

DETAILED DESCRIPTION OF PREFERRED EMBODIMENT

Figure 1:
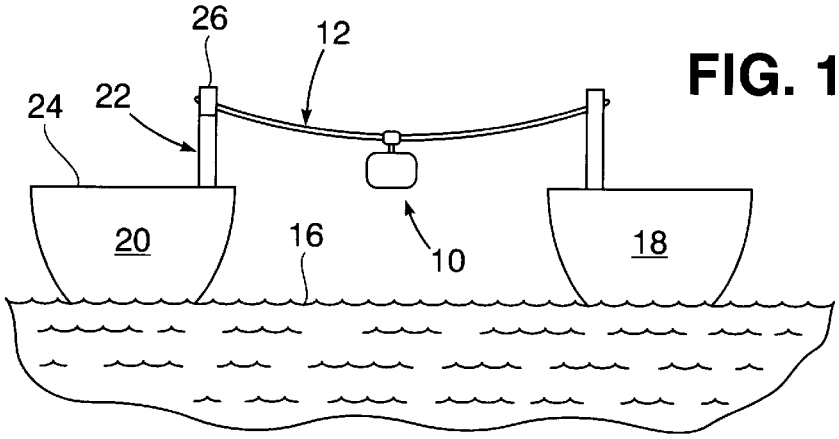
FIG. 1 is a simplified elevation view of adjacent marine vessels undergoing seawater travel during transfer of a cargo load therebetween.

Referring now to the drawing in detail, FIG. 1 shows a solid cargo load 10 being shuttled at sea along a flexible rope, such as rope wire 12, maintained at a sufficient height above the normal level of the seawater surface 16 to clear any possible seawater waves that may develop during load transfer from a replenishment ship 18 to a receiving ship 20. The wire 12 is anchored to the replenishment ship 18 through which the load 10 is brought to the vicinity of the receiving ship 20. Such wire 12 is connected to a rotational head portion 26 on a post assembly 22 mounted on the receiving ship 20. The post assembly 22 is constructed in accordance with the present invention to enclose, anchor and store the inhaul rope within the receiving ship 20 as hereinafter described.

Figure 2:
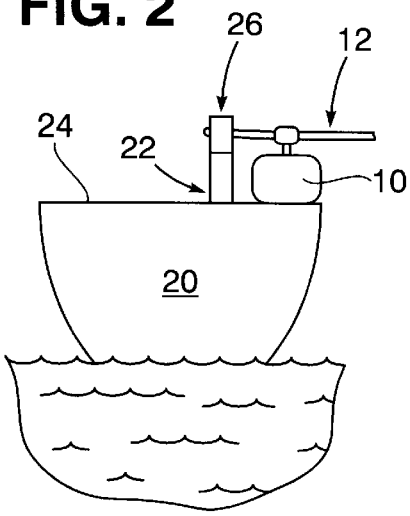
FIG. 2 is a partial simplified view of the deposit of the cargo load on the load receiving ship by the transfer operation depicted in FIG. 1.

In accordance with the present invention, the wire 12 is connected to the post assembly 22 on the receiving ship 20. While in a retracted position in the deck 24, the post assembly 22 is at a lowered height as shown in FIG. 2, from which the load 10 attached to the wire 12 is deposited onto the receiving ship deck 24 in order to complete load transfer.

Figure 3:
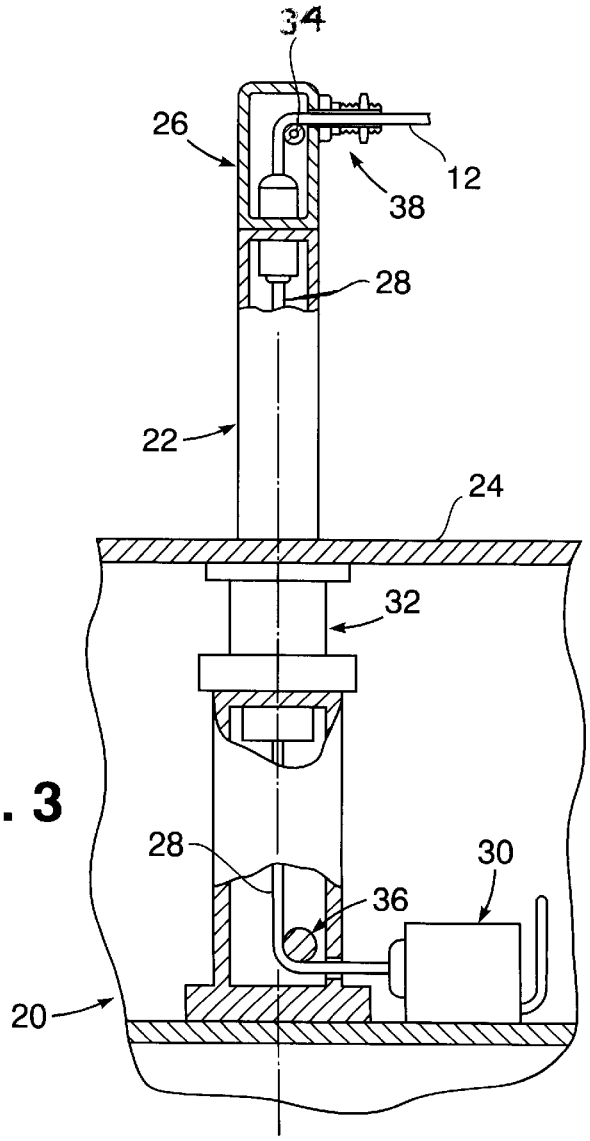
FIG. 3 is an enlarged partial section view of post structure on the receiving ship shown in FIG. 2.

FIG. 3 illustrates a structural arrangement of the post assembly 22 for achieving the foregoing load transfer by a procedure of the present invention in accordance with one embodiment. Such post assembly 22 is driven vertically from a stowage position as shown in FIG. 2 to a position fully erected as shown in FIG. 1 by means of a rack and pinion type of locking device 32 located below the deck 24 as shown in FIG. 3, of a type already known in the art which for example has associated therewith either an electrical motor with reduction gearing or a magnetostrictive type rotary actuator.

With continued reference to FIG. 3, a sheave 34 is shown mounted within the head section 26 rotatable about its longitudinal axis for movable support of the inhaul rope portion 28 extending downwardly therefrom to a lower end about a sheave 36 and then laterally outwardly into the winch device 30. A highline securing device 38 is mounted on the head portion 26 of the post assembly 22, through which the rope wire 12 is automatically extended in a highline fashion toward ship 18.

Obviously, other modifications and variations of the present invention may be possible in light of the foregoing teachings. It is therefore to be understood that within the scope of the appended claims the invention may be practiced otherwise than as specifically described.

What is claimed is:

1. In combination with a system for transferring a load between replenishment and receiving ships by a highline extension of a rope wire under tension extending between said ships, the improvement residing in: a tubular post through which an inhaul portion of the rope wire extends; means mounting the post on the receiving ship for selective displacement between erected and retracted positions to respectively accommodate highline shuttling of the load attached to the rope wire from the replenishment ship and deposit the load onto the receiving ship; and means for controlled stowage on the receiving ship of the inhaul portion of the rope wire extending from the tubular post in response to said displacement thereof to the retracted position.

2. The improvement as defined in claim 1, wherein said receiving ship has a deck onto which said deposit of the load occurs and a vertically elongated pocket in the deck through which said selective displacement of the tubular post occurs.

3. In combination with a system for transferring a load between replenishment and receiving ships by a rope wire under tension extending between said ships through a post structure establishing a predetermined height of the load above normal seawater surface level while attached to the rope wire, the improvement residing in a method comprising the steps of: operatively mounting the post structure on the receiving ship for vertical displacement; between erected and retracted positions respectively accommodating highline shuttling of the load from the replenishment ship and deposit onto the receiving ship; and withdrawing the rope wire through the post structure as the post structure moves into its retracted position into the receiving ship for storage therein after completion of the load transfer operation.

* * * * *